US008152966B2

(12) United States Patent
Eerikäinen et al.

(10) Patent No.: US 8,152,966 B2
(45) Date of Patent: Apr. 10, 2012

(54) DOCTOR APPARATUS AND A METHOD FOR A WEB FORMING MACHINE FOR DOCTORING A MOVING SURFACE AS WELL AS A BLADE HOLDER

(75) Inventors: Hannu Eerikäinen, Varkaus (FI); Reijo Hassinen, Leppävesi (FI)

(73) Assignee: Metso Paper, Inc., Helsinki (FI)

( * ) Notice: Subject to any disclaimer, the term of this patent is extended or adjusted under 35 U.S.C. 154(b) by 146 days.

(21) Appl. No.: 12/681,997

(22) PCT Filed: Oct. 3, 2008

(86) PCT No.: PCT/FI2008/050548

§ 371 (c)(1),
(2), (4) Date: Apr. 28, 2010

(87) PCT Pub. No.: WO2009/047385

PCT Pub. Date: Apr. 16, 2009

(65) Prior Publication Data

US 2010/0215857 A1 Aug. 26, 2010

(30) Foreign Application Priority Data

Oct. 10, 2007 (FI) ..... 20075718

(51) Int. Cl.
*D21G 3/00* (2006.01)

(52) U.S. Cl. ..... 162/281; 118/413; 15/256.51

(58) Field of Classification Search ..... 162/280–281; 118/123, 126, 261, 413; 15/256.5–256.51
See application file for complete search history.

(56) References Cited

U.S. PATENT DOCUMENTS

| | | | | |
|---|---|---|---|---|
| 3,158,497 | A * | 11/1964 | Fird et al. | 427/356 |
| 4,241,691 | A * | 12/1980 | Hopfe et al. | 118/126 |
| 4,367,120 | A * | 1/1983 | Hendrikz | 162/281 |
| 4,665,859 | A * | 5/1987 | Dunlap et al. | 118/126 |
| 5,597,449 | A * | 1/1997 | Vestola et al. | 162/199 |
| 5,980,692 | A * | 11/1999 | Goodnow et al. | 162/281 |
| 6,312,563 | B1 * | 11/2001 | Goodnow et al. | 162/281 |
| 6,447,646 | B1 * | 9/2002 | Hassinen et al. | 162/281 |
| 6,458,247 | B1 * | 10/2002 | Uuttana | 162/281 |

(Continued)

FOREIGN PATENT DOCUMENTS

FI 93476 12/1994

(Continued)

OTHER PUBLICATIONS

International Search Report and Written Opinion in PCT/FI2008/050548.

*Primary Examiner* — Jose A Fortuna
(74) *Attorney, Agent, or Firm* — Stiennon & Stiennon

(57) ABSTRACT

A doctor apparatus for a web forming machine for doctoring a moving surface with the doctor apparatus (10) has a blade (16), a blade holder (14) to which the blade (16) is adapted, a frame component (12) to which the blade holder (14) is adapted, and a loading element (23) arranged between the frame component (12) and the blade holder (14) for loading the blade holder (14) and further the blade (16). The loading element (23) is tied to both the frame component (12) and the blade holder (14). The invention also relates to a blade holder (14) and a method for a web forming machine for doctoring a moving surface (26).

17 Claims, 5 Drawing Sheets

U.S. PATENT DOCUMENTS

| | | | | |
|---|---|---|---|---|
| 6,524,444 | B2 * | 2/2003 | Brauns et al. | 162/281 |
| 6,687,950 | B1 * | 2/2004 | Rata et al. | 15/256.51 |
| 6,849,290 | B2 * | 2/2005 | Makinen et al. | 427/8 |
| 6,942,734 | B2 | 9/2005 | Rata et al. | |
| 7,108,766 | B1 * | 9/2006 | Eskelinen et al. | 162/263 |
| 7,618,518 | B2 * | 11/2009 | Rata et al. | 162/280 |
| 2004/0163587 | A1 * | 8/2004 | Rata | 118/123 |
| 2006/0054293 | A1 | 3/2006 | Strauch | |
| 2006/0180291 | A1 * | 8/2006 | Rata | 162/281 |
| 2006/0185812 | A1 * | 8/2006 | Rotherham | 162/280 |
| 2006/0225647 | A1 * | 10/2006 | Reid | 118/261 |
| 2006/0289141 | A1 * | 12/2006 | Rata et al. | 162/280 |
| 2009/0148208 | A1 * | 6/2009 | Gauvin et al. | 399/351 |
| 2010/0215857 | A1 * | 8/2010 | Eerikainen et al. | 427/294 |

FOREIGN PATENT DOCUMENTS

| | | | |
|---|---|---|---|
| WO | 01/25533 | A1 | 4/2001 |
| WO | 2009/047385 | A1 | 10/2008 |

* cited by examiner

DOCTOR APPARATUS AND A METHOD FOR A WEB FORMING MACHINE FOR DOCTORING A MOVING SURFACE AS WELL AS A BLADE HOLDER

CROSS REFERENCES TO RELATED APPLICATIONS

This application is a U.S. national stage application of International App. No. PCT/FI2008/050548, filed Oct. 3, 2008, the disclosure of which is incorporated by reference herein, and claims priority on Finnish App. No. 20075718, filed Oct. 10, 2007.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a doctor apparatus for a web forming machine for doctoring a moving surface with the doctor apparatus including a blade, a blade holder to which the blade is adapted, a frame component to which the blade holder is adapted, and a loading element is arranged between the frame component and the blade holder for loading the blade holder and further the blade.

The invention also relates to a blade holder and a method for a web forming machine for doctoring a moving surface.

At present, an apparatus for doctoring a moving surface is known, for example, from publication U.S. Pat. No. 6,942,734. The apparatus includes a frame component to which a blade holder is connected. The blade holder, in turn, has a blade connected thereto. The blade holder is loaded with a loading hose and for the loading hose, on the other hand, a counter force is provided with an opening hose. In other words, the opening hose providing the counter force for the loading hose is used to open the gap between the blade and a roll surface. There are known several corresponding apparatuses in which the gap between a blade and a roll surface is opened by means of an opening hose and closed by means of a loading hose. However, a common problem with the use of these is that the design of the opening hose is restricted, which means that the opening of the gap between the blade and the roll surface is also restricted. An opening hose and a loading hose also substantially complicate the removal of the blade holder from the frame component.

Publication WO 01/25533 proposes a doctor blade holder and a method for using a doctor. In this publication, it is proposed that the counter force for the loading hose is produced with flexible plates. Plates, however, fatigue in the course of time, whereby the apparatus fails to function as planned.

SUMMARY OF THE INVENTION

The object of the invention is to provide a novel doctor apparatus which can be connected to a web forming machine economically more advantageously than before. The characteristic features of this invention are that the loading element is tied to both the frame component and the blade holder. A further object of the invention is to provide a novel blade holder which can be removed and set in place more easily than before. The characteristic features of this invention are that the blade holder includes only one loading element groove adapted to bidirectional loading. A still further object of the invention is to provide a novel method for a web forming machine for doctoring a moving surface. In the method, the blade holder turns to a larger extent than before. The characteristic features of this invention are that the gap between the blade and the surface is adjusted with a loading element which is tied to both the frame component and the blade holder.

In the method according to the invention, the gap between a blade and a surface in a web forming machine is adjusted. A moving surface is doctored with the blade. A web manufacturing machine refers to machines intended for manufacturing paper, tissue or board. A web, in turn, is used to refer to board, tissue and paper webs. The gap between the blade and the surface is adjusted with a loading element. Surprisingly, the gap between the blade and the surface is adjusted with a loading element which is tied to both a frame component and a blade holder. Locating the loading element in a new way enables both loading the surface to be doctored and detaching the blade from the surface to be doctored with the loading element.

In an embodiment, a loading hose is used as the loading element, which is depressurized for adjusting the gap between a blade and a surface to be doctored. Adjusting the gap between the blade and the surface to be doctored by depressurizing the loading hose enables locating the loading hose in a new way. When locating the loading hose in a new way, it is possible to make the loading hose, for example, larger than before, which allows opening the gap between the blade and the surface to a greater extent.

In a second embodiment, the gap between the blade and the surface is opened by depressurizing a loading hose. Opening the gap between the blade and the surface by depressurizing the loading hose is useful since the gap between the blade and the surface needs to be open only for short periods of time. Such periods of time exist in connection with shutdowns and grade changes. In turn, the time the gap between the blade and the surface remains closed, i.e. loading the surface with the blade, is long, in which case a vacuum would be needed for long periods of time in a loading system implemented with a vacuum. Generating an overpressure is more economical than generating a vacuum. Opening the gap between the blade and the surface is thus more advantageous with a vacuum than loading a roll surface with a vacuum.

In a third embodiment, a full or an overpressurized loading hose includes a first wall portion, a second wall portion and a third wall portion, and when depressurizing the loading hose, the third wall portion remains between the first wall portion and the second wall portion. Thus the loading hose becomes a lot smaller and thereby moves the blade holder tied thereto and the frame component relative to each other increasingly when the loading hose is depressurized.

In a fourth embodiment the gap between the blade and the surface is closed by overpressurizing a loading hose. In other words, the same loading hose is used for both opening and closing the gap between the blade and the surface. When using the same loading hose for both closing and opening, it is sufficient to have one loading hose instead of two. Loading hoses and particularly pressure pipes led to these create high costs, which can be remarkably reduced when using a single loading hose for opening and closing the gap between the blade and the surface.

The invention is described below in detail by making reference to the drawings, which illustrate some of the embodiments of the invention.

DESCRIPTION OF THE PREFERRED EMBODIMENTS

Figure 1A:
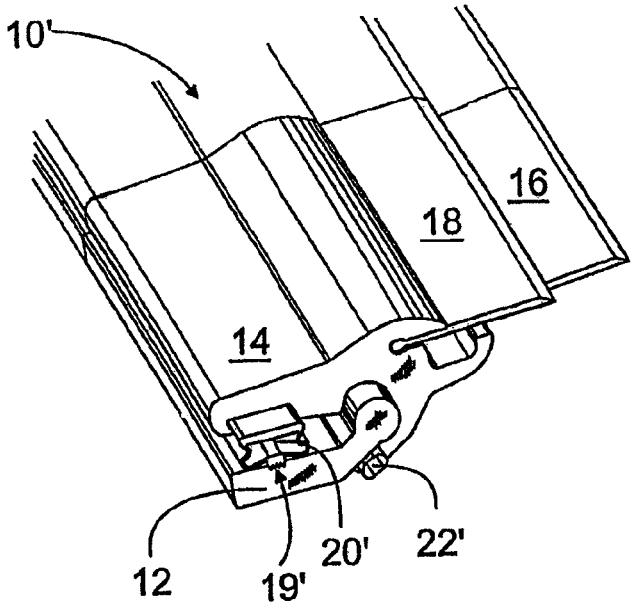
Prior Art Fig. 1a
FIG. 1*a* shows a doctor apparatus according to prior art.

FIG. 1*a* illustrates a doctor apparatus 10' according to prior art. The doctor apparatus 10' according to prior art includes a frame component 12, to which a blade holder 14 is connected. A blade 16 and a presser blade or a pressure plate 18 are in turn connected to the blade holder 14. The blade holder 14 is loaded with a loading element 19', more precisely with a loading hose 20', while an opening hose 22' provides the counter force for the loading hose 20'. The loading hose 20' is adapted to close the gap between the blade 16 and a roll surface 26. The opening hose 22', in turn, is adapted to open the gap 38 between the blade 16 and the roll surface. The size of the opening hose and the projection required by the opening hose in the blade holder restrict the opening of the gap between the blade and the surface. The location of the opening hose, in turn, restricts the size of the opening hose. Two separate loading hoses also complicate the removal of the blade holder from the frame component, due to friction. Each loading hose also increases attachment of dirt to the doctor apparatus. Moreover, two separate loading hoses require two separate pipeworks for leading a vacuum to the loading hoses. Two separate pipeworks make a significant cost item since a web forming machine has several doctor apparatuses.

Figure 1B:
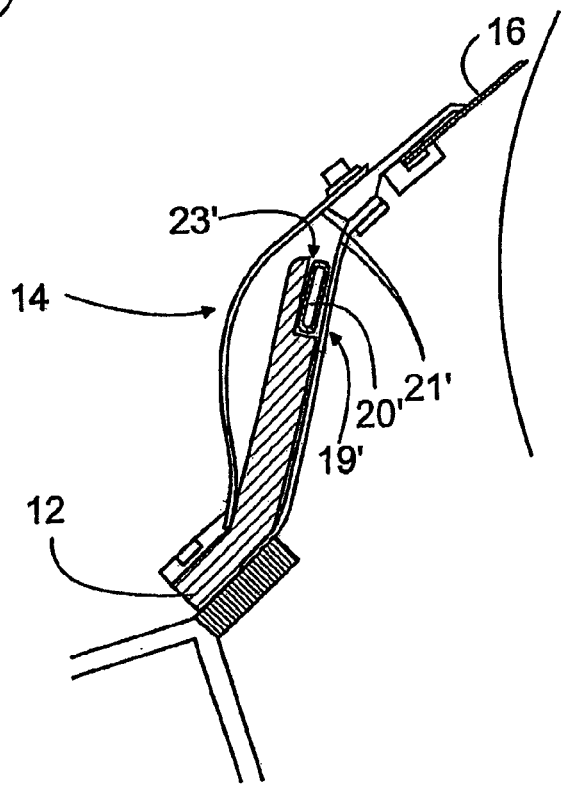
Fig. 1b Prior Art
FIG. 1*b* shows another doctor apparatus according to prior art.

FIG. 1*b* shows another doctor apparatus according to prior art. A loading element 19', more precisely a loading hose 20', is located between a frame component 12 and a blade holder 14.

The blade holder consists mainly of plates 21'. The frame component 12 has a profile 23' for the loading element 19' or more precisely for the loading hose 20', but the blade holder does not have a corresponding profile. The operating principle of the doctor apparatus shown in FIG. 1*b* is different from that of the one shown in FIG. 1*a*. Although the loading force is generated in a corresponding way with the loading hose 20, the counter force is generated with flexible plates 21'. Plates, however, fatigue in the course of time, whereby the entirety will no more function as desired. Such a doctor apparatus requires space and the movement allowed for the blade is small. Keeping the loading hose in place is also a problem.

Figure 2:
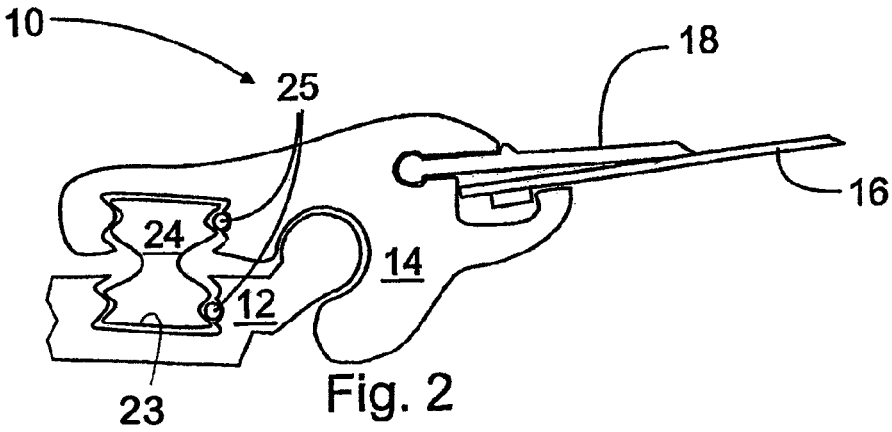
FIG. 2 shows an embodiment of the doctor apparatus according to the invention.

FIG. 2 shows the doctor apparatus 10 according to the invention for a web forming machine for doctoring a moving surface. The doctor apparatus includes a blade 16, which is adapted to doctor a moving surface. The blade 16 is adapted in a blade holder 14, which is adapted in a frame component 12. The blade 16 is supported by a presser plate 18. A loading element 23 is arranged between the frame component 12 and the blade holder 14 for loading the blade holder 14 and further the blade 16. In addition, both the frame component 12 and the blade holder 14 are tied to the loading element 23 for moving the blade holder and further the blade 16 to a direction opposite to loading. The loading element 23 is supported in place with fastening rods 25. In the doctor apparatus according to the invention, the loading element can move the blade into two directions. When only one loading element is required for the doctor apparatus instead of the previous two, the entirety can be made simpler and easier to manufacture. The loading element can consist of sections or it can be continuous. The operation of the loading element can be based on pressure variation, for example, as in a hose. Heat expansion can also be utilized in the loading element since heat expansion is uniform and provides uniform loading.

A doctor apparatus can be used to clean a roll or a belt, for example, by doctoring. A doctor apparatus can also be used to detach a web from the proximity of a belt or a roll. A doctor blade is used to detach, for example, a paper web from a moving surface or to keep the surface of a moving element otherwise clean by doctoring. The moving element can be a roll or a belt, for example. A doctor apparatus can also be used in connection with coating or creping.

In the doctor apparatus 10 shown in FIG. 2 the loading element 23 is a loading hose 24. With a loading hose, uniform loading is achieved by utilizing an overpressure. The use of overpressure is advantageous in a paper machine since it is used in many applications and it is a very reliable solution. In addition, pressurized air does not soil. The loading hose used for generating the load can also consist of sections, but advantageously the loading hose is continuous. The loading hose 24 is supported in place with fastening rods 25. The loading hose contracts when it is depressurized. On the other hand, the loading hose expands when it is overpressurized. The terms 'vacuum' and 'overpressure' are used to refer to the pressure level prevailing within a pipe compared to the pressure level surrounding the pipe. The doctor apparatus according to the invention assists in saving a remarkable amount of work and pipe material in the machine construction as a pipe of its own is installed for each loading hose of the doctor apparatus for applying pressurized air for these. In the doctor apparatus according to the invention, one loading hose can move the blade into two directions. When only one loading hose is required for the doctor apparatus instead of the previous two, only one pipe is also required instead of the previous two. Thus the savings in constructing the web forming machine are significant. The saving is significant since doctor apparatuses in which the invention can be utilized are typically about 20 in number in a paper machine. For each doctor, for example, 10 mm pipe is installed for a length of 20 m. Merely the pipes made of stainless steel cost tens of thousands, even hundreds of thousands of euros. Besides pipes, the amount of other pneumatic components required is also smaller, which will create savings correspondingly. Remarkable savings are also made in the installation costs.

Figure 3A:
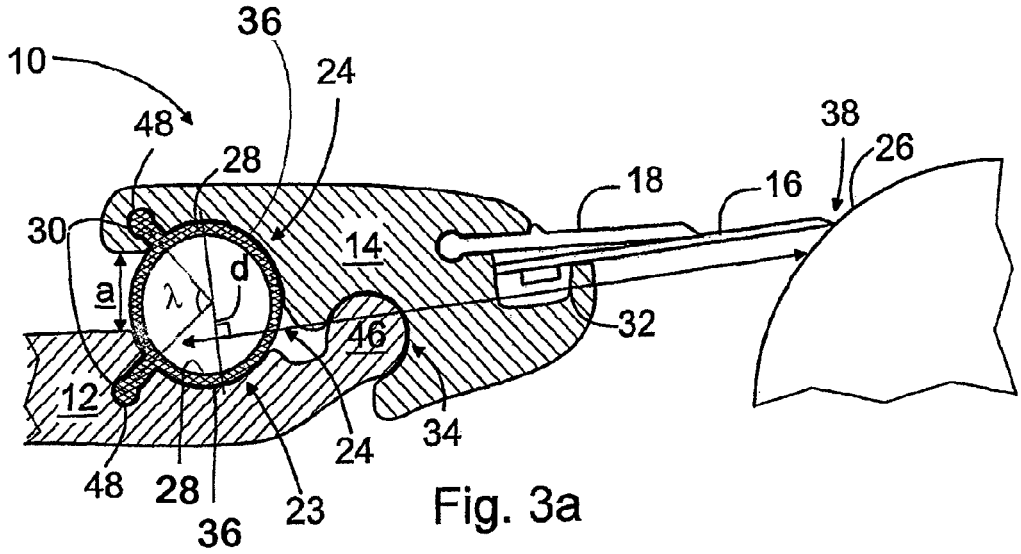
FIG. 3*a* shows another embodiment of the doctor apparatus according to the invention with the blade contacting the roll surface.

FIG. 3*a* shows the doctor apparatus 10 according to the invention with the blade 16 contacting the roll surface 26. The cross section of the wall 28 of the loading hose 24 used is curved for a portion exceeding 70%, preferably for a portion exceeding 90%. Thus the loading hose has fastening profiles, for example, over a portion smaller than 30%, preferably over a portion smaller than 10%. In other words, the loading hose 24 is free of sharp angles. When the surface of the loading hose 24 is curved, hose grooves 36 in the blade holder 14 and the frame component 12 are also curved. With the walls being curved, placing the loading hose between the blade holder and the frame component is easier than before. Typically the loading hose is inserted between the blade holder and the frame component from the end. On the other hand, it is possible to contemplate a case in which the loading hose remains in place in the frame component and the blade holder is removed. It is essential that removing the blade holder is easier and faster than before. Then the blade holder can be removed for cleaning, for example, or it can be completely replaced faster than before. Furthermore, a curved surface does not collect dirt in a similar way as angular shapes. Moreover, a curved surface is easier to clean.

In the doctor apparatus 10 according to the invention shown in FIG. 3*a*, the cross section of the loading hose 24 is substantially circular. Advantageously, the cross section of the loading hose is substantially circular at some stage of loading. A loading hose with a circular cross section is an advantageous embodiment from the curved shape due to easy replaceability and good properties of keeping clean. Advantageously, the loading hose has a silicone construction whereby it slides in place more easily than before. A pipe with a silicone construction provided with curved walls is easy and economical to manufacture with pultrusion as well as extrusion. From the economical point of view it should be noted that the manufacturing costs of a curved, mainly circular, loading hose are only about a fifth of the price of a loading hose with an angular shape. A loading hose with an angular shape refers to, for example, the design of the loading hose shown in FIG. 2, in which keeping the loading hose in place is based on the angular basic design of the loading hose as well as on fastening rods.

The replacement of the blade holder is partially facilitated by the fact that when the loading hose is in the depressurized state, the blade is not loaded against the roll surface. Removing the blade holder from the frame component is simpler than before when there is only one loading hose and even the one loading hose is depressurized.

Figure 3B:
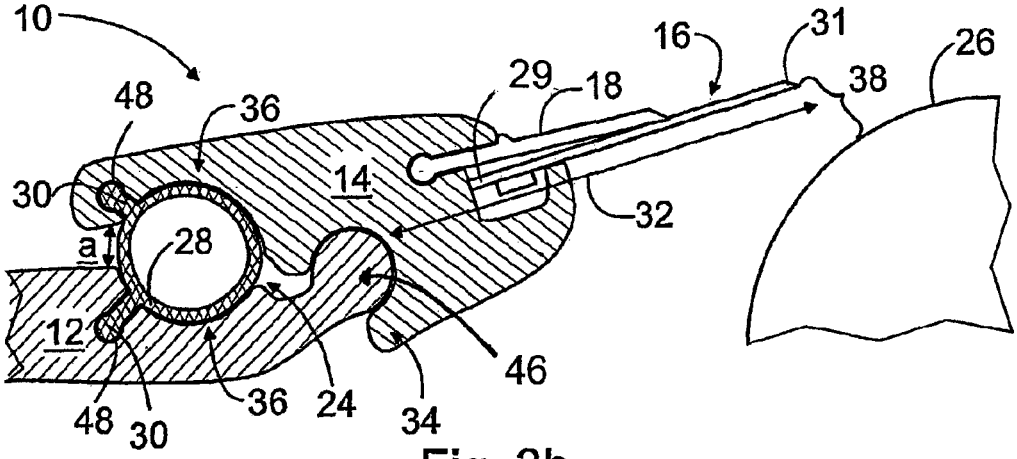
FIG. 3*b* shows the doctor apparatus of FIG. 3*a* with the blade detached from the roll surface.

FIG. 3*b* shows the doctor apparatus 10 according to the invention shown in FIG. 3*a* with the blade 16 detached from the roll surface 26. Thus there is a gap 38 between the blade 16 and the roll surface 26. Between the blade holder 14 and the frame component 12 there is a connection 34 allowing turning, and the loading element, more precisely the loading hose 24, is on the opposite side, relative to the blade, of the connection 34 allowing turning in the direction parallel with the blade 16. The expression 'in the direction parallel with the blade 16' means here the direction from the tip 31 of the blade 16 to the base 29 of the blade. The direction parallel with the blade is indicated with a double-headed arrow 32. In other words, the loading hose 24 is depressurized for detaching the blade 16 from the roll surface 26. When the blade is detached from the roll surface by means of a vacuum, a vacuum is needed only for a small portion of the total time. In addition, the vacuum does not need to be high for moving the blade holder and further the blade. When doctoring with the blade, higher forces and more long-lasting pressure are required. Hence, the loading hose is advantageously depressurized for detaching the blade from the roll surface and overpressurized for loading the blade against the roll surface. An ejector uses pressurized air of about 70 l/min for generating a vacuum, therefore the consumption of pressurized air during the replacement is very low.

In the doctor apparatus 10 shown in FIGS. 3*a* and 3*b*, the loading hose 24 includes opposite fastening profiles 30 for tying both the frame component 12 and the blade holder 14 to the same loading hose 24. With opposite fastening profiles, forces provided by the vacuum of the loading hose during contraction are conveyed to the frame component and the blade holder. In addition, the fastening profiles keep the loading hose with mainly curved walls in place also upon the overpressurization of the loading hose. Advantageously, there are two fastening profiles. Thus the loading hose can be kept securely in place conveying the forces as desired. On the other hand, the loading hose lacks unnecessary fastening profiles, which would unnecessarily complicate the installation of the loading hose. Moreover, each fastening profile produces costs in the manufacturing stage.

In the doctor apparatus 10 according to the invention shown in FIG. 3*a*, there is a connection 34 allowing turning between the blade holder 14 and the frame component 12. The loading hose 24 is located in hose grooves 36 provided in the blade holder 14 and the frame component 12. The hose grooves 36 are provided with counter profiles 48 for the fastening profiles 30. In addition, the fastening profiles 30 are on the opposite side of the diameter d of the loading hose 24 relative to the connection 34 allowing turning between the blade holder 14 and the frame component 12. The diameter d of the loading hose 24 is at the right angle relative to the longitudinal direction of the blade 16. When the fastening profiles are on the other side of the loading hose diameter than the connection allowing turning, the movement of the loading hose can be efficiently transferred to the movement of the blade holder.

In the doctor apparatus 10 shown in FIG. 3*a*, the gap 38 between the blade 16 and the roll surface 26 is formed between the roll surface 26 and the tip 31 of the blade 16. Although the tip 31 is in contact with the roll surface, it is possible to talk about a gap between the blade and the roll surface. When the blade contacts the roll surface while adjusting the gap between the blade and the roll surface, the force of the blade loading the roll surface is adjusted. The blade 16 is fastened to the blade holder 14, which is further supported to the frame component 12. In addition, the loading hose 24 is located between the blade holder 14 and the frame component 12 in such a way that the distance between the blade holder 14 and the frame component 12 decreases at the loading hose when depressurizing the loading hose 24. Correspondingly, the distance a between the blade holder 14 and the frame component 12 decreases on the side of the loading hose 24 of the connection 34. The connection 34 allows turning of the blade holder 14 relative to the frame component 12. As the blade holder 14 turns relative to the frame component 12 upon the depressurization of the loading hose 24, the blade 16 detaches from the roll surface 26.

In the doctor apparatus 10 shown in FIG. 3*a*, the distance a between the blade holder 14 and the frame component 12 increases when the loading hose is overpressurized. Certainly, as the blade 16 encounters the roll surface 26, the blade holder 14 cannot turn more, whereby the distance a does not increase any more remarkably. As the blade 16 and the presser plate 18 bend, the distance a increases slightly. Then the force produced by the overpressurized loading hose 24 is directed as a load to the gap 38 between the blade and the roll surface.

In the doctor apparatus 10 according to the invention shown in FIG. 3*a*, the angle λ between the opposite fastening profiles 30 is 40-140°. Thus the position of the fastening profiles enables good movability together with strong constructions. By strong constructions is meant here that the counter profile of the fastening profile does not come too close to the edge of the construction in the blade holder or in the frame component. Advantageously, the angle λ is 70-110° in order that ample movability is achieved with strong constructions.

In the doctor apparatus 10 shown in FIG. 3*a*, the fastening profiles 30 are protruding from the loading hose 24. Then the counter profiles 48 of the fastening profiles 30 are inside the frame component 12 and the blade holder 14. Thus it is possible to manufacture a loading hose 24 which is thin but still resistant. When the loading hose is mainly thin, the loading hose contracts even at a low vacuum. The blade holder and the frame component, on the other hand, can be made more resistant as they are free of projections.

Figure 4:
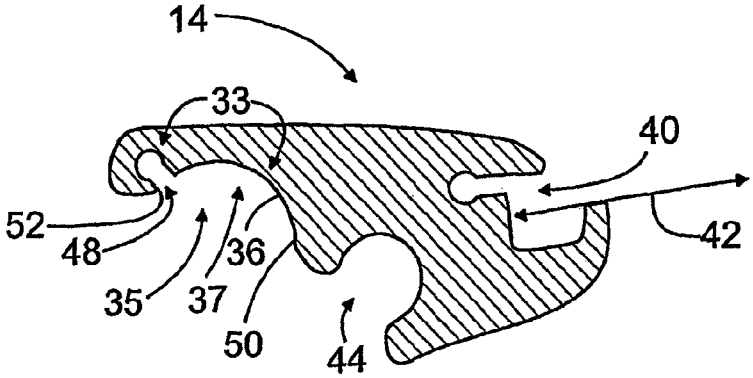
FIG. 4 shows the blade holder according to the invention.

FIG. 4 shows the blade holder 14 according to the invention. The blade holder is used in a doctor apparatus in a web forming machine for doctoring a moving surface. The blade holder 14 includes a loading element groove 35. In addition, the blade holder 14 includes only one loading element groove 35 adapted to bidirectional loading. The blade holder 14 is adapted to be connected to a frame component 12 in such a way that a loading element 23 (FIG. 3*a*) is adapted between the blade holder 14 and the frame component 12 in the loading element groove 35. A blade holder comprising only one loading element groove is used in a doctoring apparatus provided with one loading hose. Such a doctoring apparatus is economically more advantageous to install as described above. A blade holder comprising only one hose groove is also easier to mount in place than before.

The blade holder shown in FIG. 4 includes profiles 33 for fastening the loading element 23 (FIG. 3*a*). Furthermore, the profiles 33 for fastening the loading element 23 consist of one loading element groove 35. in other words, the profiles 33 with which the loading element is fastened to the blade holder form together one loading element groove 35. Such a blade holder comprises only one loading element groove.

The blade holder 14 according to the invention shown in FIG. 4 has a blade groove 40. The blade 16 (FIG. 3*a*) is adapted to be fastened to the blade groove 40.

The blade holder 14 has a connection component 44 allowing turning for fastening the blade holder 14 to the frame component 12 (FIG. 3*a*). Correspondingly, the frame component 12 is provided with a connection component 46 for fastening the blade holder 14 to the frame component 12 (FIG. 3*a*). The connection components 44, 46 form a connection 34 allowing turning. In addition, the loading element groove 35 is on the opposite side of the connection component 44, relative to the blade groove 40, in the direction parallel with the blade groove 40. The expression "direction parallel with the blade groove" refers to the direction which is congruent with the blade direction. The direction of the blade 16 is indicated with the double-headed arrow 32 in FIGS. 3*a* and 3*b*. The direction of the blade groove 40, in turn, is indicated with the double-headed arrow 42 in FIG. 4.

In the blade holder 14 shown in FIG. 4, the loading element groove 35 is a hose groove 36. In this case, a hose providing uniform loading is used as the loading element. In the blade holder 14, the hose groove 36 has an edge 50 on the side of the connection component 44 and an outer edge 52. Advantageously, the counter profile 48 is closer to the outer edge 52 than to the edge 50 on the side of the connection component 44.

In the blade holder shown in FIG. 4 the loading element groove 35 includes a counter profile 48 and a loading element profile 37. The force applied during doctoring is conveyed to the blade holder via the loading element profile. A force affecting in another direction is conveyed to the blade holder, in turn, via the counter profile. In other words, the counter profile keeps the loading element in place when contracting the loading element.

Figure 5A:
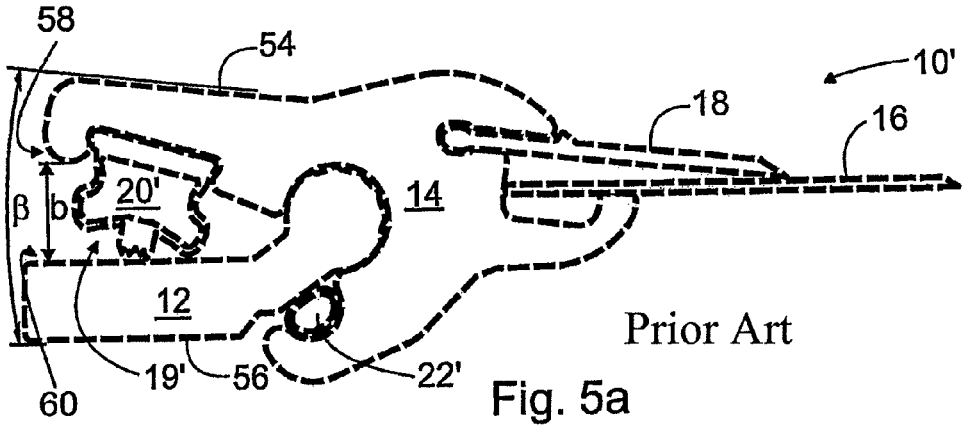
FIG. 5*a* shows a doctor apparatus according to prior art in the closed position.
Figure 5B:
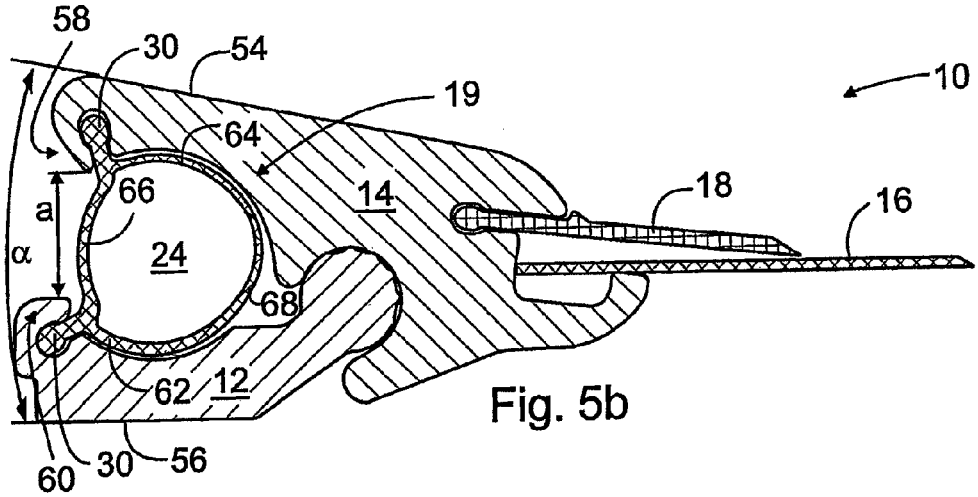
FIG. 5*b* shows the apparatus according to the invention in the closed position.
Figure 5C:
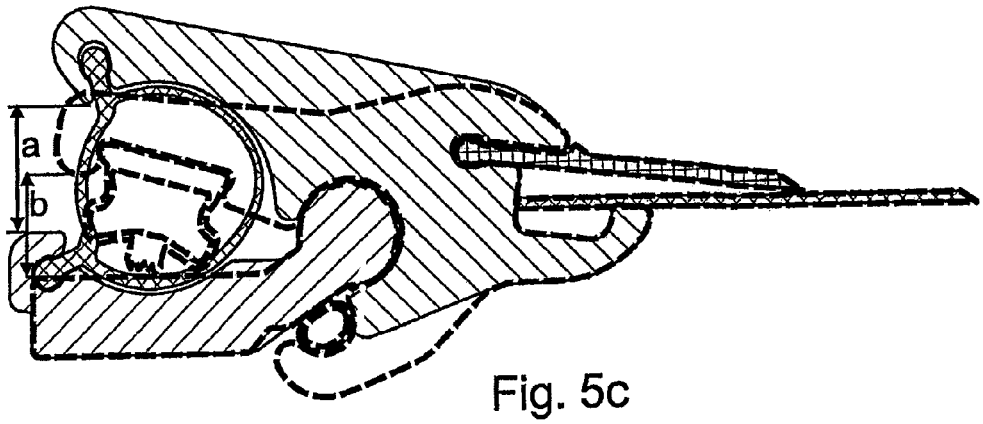
FIG. 5*c* shows FIGS. 5*a* and 5*b* set on top of each other.

FIG. 5*a* illustrates a doctor apparatus 10' according to prior art in the closed position. Correspondingly, FIG. 5*b* shows the doctor apparatus 10 according to the invention in the closed position. In the closed position, a surface is doctored with the blade of a doctor apparatus. In other words, the blade included in the doctor apparatus is loaded against the surface. In the closed position, the loading element 19, 19' included in the doctor apparatus is in an extreme position as large as possible. In FIG. 5*c*, FIGS. 5*a* and 5*b* are shown placed on top of each other such that the differences between the application according to prior art and the application according to the invention in the closed position are revealed in the same figure.

In the doctor apparatus 10 according to prior art shown in FIG. 5*a*, the angle β between the outer surface 54 of the blade holder 14 and the outer surface 56 of the frame component 12 is 6°. The distance b between the rear profile 58 of the blade holder 14 and the rear profile 60 of the frame component 12 is 16 mm.

In the doctor apparatus 10 according to the invention shown in FIG. 5*b*, the angle α between the outer surface 54 of the blade holder 14 and the outer surface 56 of the frame component 12 is 9°. Angles α and β have been measured in such a way that the outer surface 56 of the frame component 12 forms a side of the angle and the angle is given as a positive value measured clockwise from the side formed by the outer surface 56 to a side formed by the outer surface 54. The distance a between the rear profile 58 of the blade holder 14 and the rear profile 60 of the frame component 12 is 21 mm.

FIG. 5*c* reveals that the distance a in the doctor apparatus according to the invention is greater than the corresponding distance b in the doctor apparatus according to prior art.

The full or overpressurized loading hose 24 of the doctor apparatus 10 shown in FIG. 5*b* includes a first wall portion 62, which is outwardly curved, a second wall portion 64, which is outwardly curved, and a third wall portion 66, which is outwardly curved. The wall portions 62, 64 and 66 are advantageously mutually substantially of the same size. The wall portions being substantially of the same size, each of them covers 90-150°, advantageously 105-135°, of the diameter of the loading hose 24. When the wall portions themselves are curved, the cross section of the loading hose is substantially circular. In other words, a small deviation from a circular shape may exist between the curved wall portions but as the deviation is small, the cross section has a substantially circular shape.

Figure 6A:
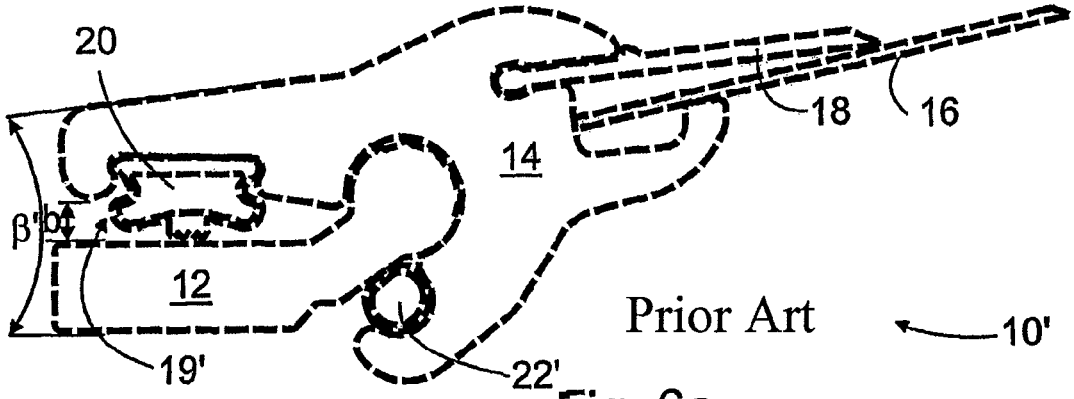
FIG. 6*a* shows a doctor holder according to prior art in the neutral position.
Figure 6B:
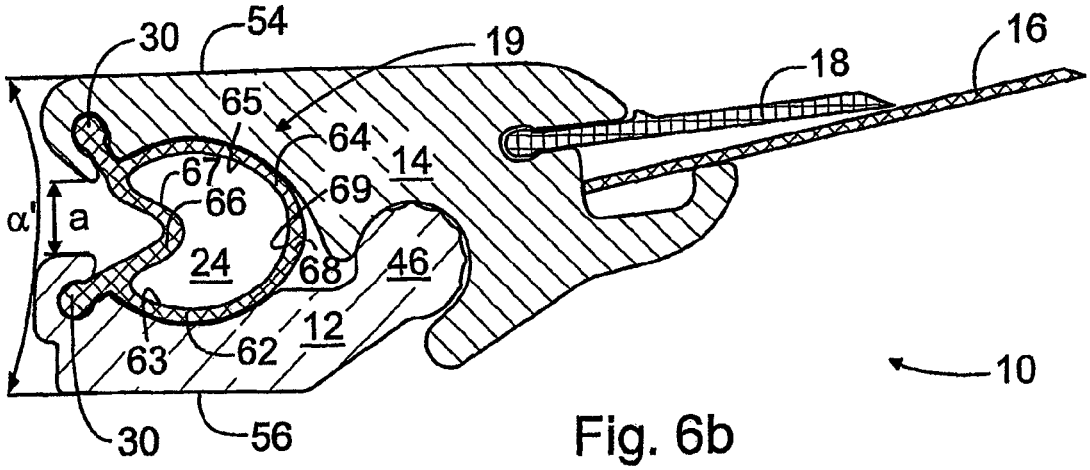
FIG. 6*b* shows the doctor holder according to the invention in the neutral position.
Figure 6C:
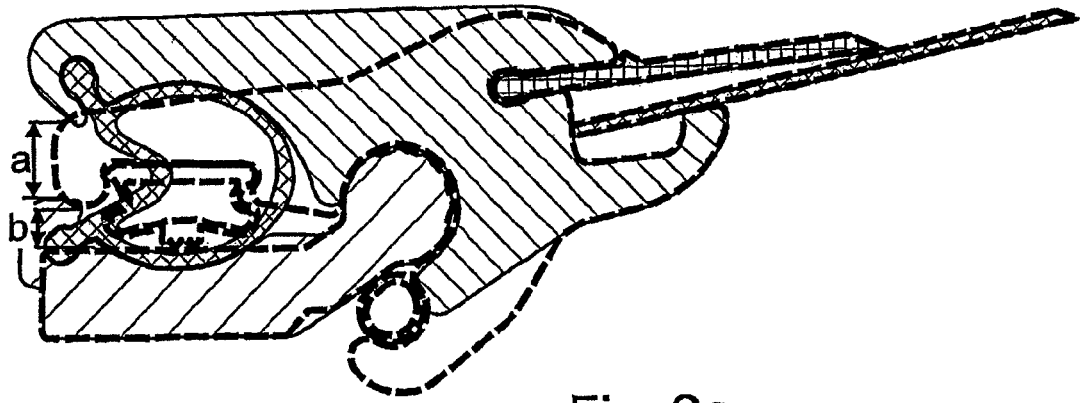
FIG. 6*c* shows FIGS. 6*a* and 6*b* set on top of each other.

FIG. 6*a* illustrates a doctor apparatus 10' according to prior art in the neutral position. FIG. 6*b* shows the doctor apparatus 10 according to the invention correspondingly in the neutral position. In the neutral position, a surface is no more doctored with the blade of a doctor apparatus. The blade is typically detached from the surface to be doctored, but the blade can still contact the surface to be doctored. If the blade contacts the surface, the contact is light and not suitable for doctoring. In the doctor apparatus 10' according to prior art, the loading element 19' is then contracted almost to the extreme position. In the doctor apparatus 10 according to the invention, the loading element 19 is slightly contracted. In FIG. 6*c*, FIGS. 6*a* and 6*b* are shown placed on top of each other such that the differences between the application according to prior art and the application according to the invention in the neutral position are revealed in the same figure.

In the doctor apparatus 10' according to prior art shown in FIG. 6*a*, the angle β' between the outer surface 54 of the blade holder 14 and the outer surface 56 of the frame component 12 is 5°, therefore the explementary angle β is 355°. The distance b between the rear profile 58 of the blade holder 14 and the rear profile 60 of the frame component 12 is 7 mm. Compared to the closed position, the angle between the frame component and the blade holder has decreased by 11° and the distance b by 9 mm.

In the doctor apparatus 10 according to the invention shown in FIG. 6*b*, the angle α' between the outer surface 54 of the blade holder 14 and the outer surface 56 of the frame component 12 is 2°, therefore the explementary angle α is 358°. The distance a between the rear profile 58 of the blade holder 14 and the rear profile 60 of the frame component 12 is 12 mm. Compared to the closed position, the angle between the blade holder and the frame component has decreased by 11° and the distance b by 9 mm.

FIG. 6*c* reveals that in the doctor apparatus according to the invention, remarkable turning of the blade holder relative to the frame component is possible. In turn, in the doctor apparatus according to prior art, the blade holder can no more move a lot relative to the frame component.

In the doctor apparatus 10 shown in FIG. 6*b*, the loading hose 24 is a circuit formed by a first wall portion 62, a second wall portion 64, a third wall portion 66, and a fourth wall portion 68. The third wall portion is included in the circuit between the first wall portion and the second wall portion. Correspondingly, the fourth wall portion is included in the circuit between the first wall portion and the second wall portion. The fourth wall portion 68 included in the loading hose 24 is on the side of the connection component 46. The third wall portion 66, in turn, is on the opposite side of the loading hose 24 relative to the connection component 46. The fourth wall portion functions as a hinge element when depressurizing the loading hose.

In FIG. 6*b*, the first wall portion 62 is in connection with the frame component 12 and the second wall portion 64 is in connection with the blade holder 14. The fastening profiles 30 define the fourth wall portion 66, which is in the loading hose circuit between the first wall portion 62 and the second wall portion 64. In the neutral position and in the open position (FIG. 7*b*) the third wall portion 66 is detached from the blade holder 14 and the frame component 12. The fourth wall portion 68 of the loading hose 24 located on the side of the connection component 46 is detached from the blade holder 14 and the frame component 12 when in the closed position (FIG. 5*b*) and, over a partial distance, when in the neutral position and in the open position as well (FIG. 7*b*).

In the doctor apparatus 10 shown in FIG. 6*b* the inner surface 63 of the first wall portion 62 and the inner surface 65 of the second wall portion 64 of the loading hose are concave in the overpressurized and depressurized states as seen from inside of the loading hose. Advantageously, the inner surface 69 of the fourth wall portion 68 is also concave in both the overpressurized and depressurized states. In addition, the inner surface 67 of the third wall portion 66 is concave in the overpressurized state (FIG. 5*b*) and convex in the neutral position as well as in the depressurized state (FIG. 7*b*).

In the doctor apparatus 10 shown in FIG. 6*b*, the inner surface 67 of the third wall portion 66 of the loading hose 24 is convex in the depressurized state. In the doctor apparatus 10 shown in FIG. 5*b*, in turn, the inner surface 67 of the third wall portion 66 of the loading hose 24 is concave in the overpressurized state. This is as seen from inside of the loading hose.

In the doctor apparatus 10 shown in FIG. 6*b*, the loading hose 24 includes a first wall portion 62, a second wall portion 64 and a third wall portion 66, and there are provided fastening profiles 30 on both sides of the third wall portion 66. Thus the loading hose 24 can be connected to the frame component 12 along the first wall portion 62 and connected to the blade holder along the second wall portion 64. Thus the hose does not move substantially along its first wall portion relative to the blade holder. Correspondingly, the hose does not move substantially along the second wall portion relative to the frame component.

Figure 7A:
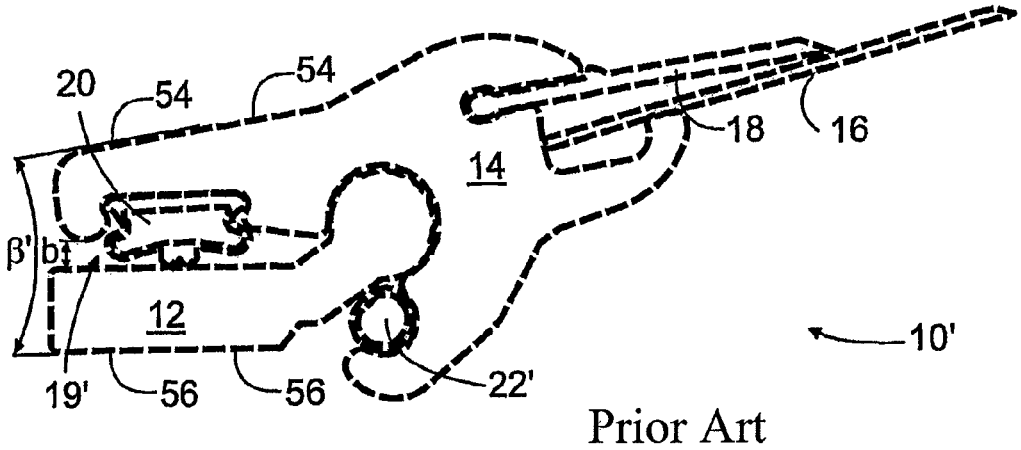
FIG. 7*a* shows a doctor holder according to prior art in the open position.
Figure 7B:
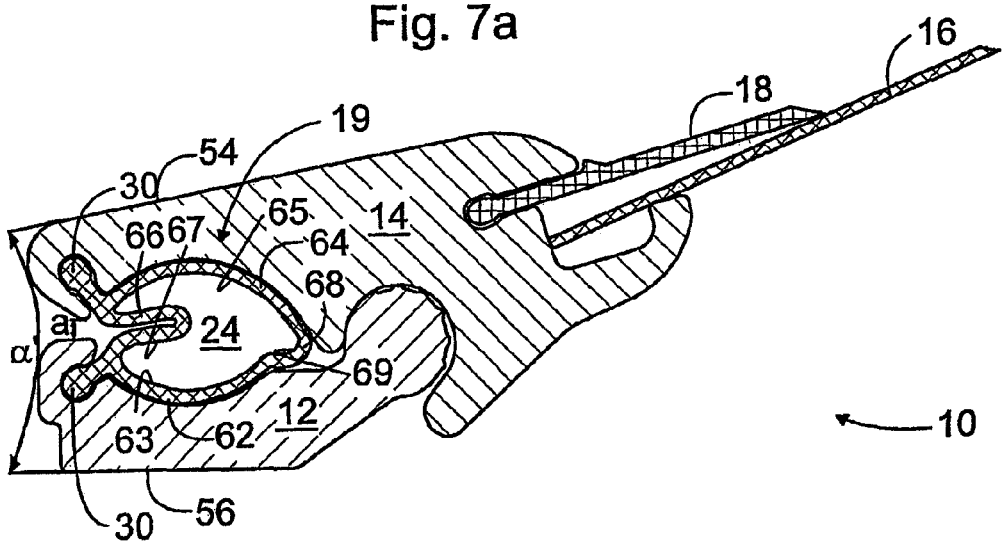
FIG. 7*b* shows the doctor holder according to the invention in the open position.
Figure 7C:
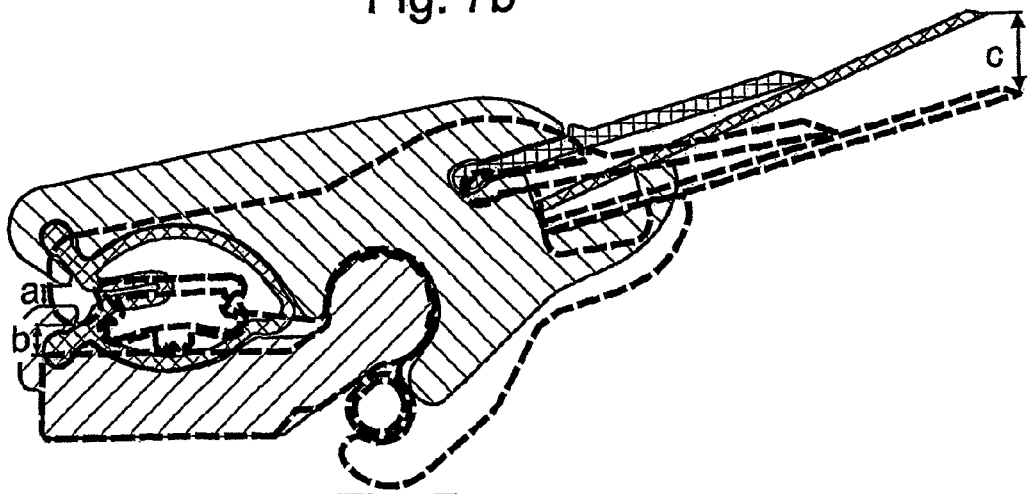
FIG. 7*c* shows FIGS. 7*a* and 7*b* set on top of each other.

FIG. 7*a* illustrates a doctor apparatus 10 according to prior art in the open position. FIG. 7*b* shows the doctor apparatus 10 according to the invention correspondingly in the open position. In the open position, a surface is not doctored with the blade of a doctor apparatus. The blade is detached from the surface to be doctored. Thus the blade can be removed from the doctor apparatus. In the doctor apparatus 10' according to prior art, the loading element 19' is then fully contracted to the extreme position. Correspondingly, the opening hose 22' has filled up for detaching the blade from the surface to be doctored. Correspondingly, in the doctor apparatus 10 according to the invention, the loading element is contracted to the extreme position. In FIG. 7*c*, FIGS. 7*a* and 7*b* are shown placed on top of each other such that the differences between the application according to prior art and the application according to the invention in the open position are revealed in the same figure.

In the doctor apparatus 10' according to prior art shown in FIG. 7*a*, the angle β' between the outer surface 54 of the blade holder 14 and the outer surface 56 of the frame component 12 is 8°, i.e. the explementary angle β is 352°. The distance b between the rear profile 58 of the blade holder 14 and the rear profile 60 of the frame component 12 is 4.7 mm. Compared to the closed position, the angle between the blade holder and the frame component has decreased by 14° and the distance b by 11.3 mm.

In the doctor apparatus 10 according to the invention shown in FIG. 7*b*, the angle α' between the outer surface 54 of the blade holder 14 and the outer surface 56 of the frame component 12 is 12° and the explementary angle α is 348°. The distance a between the rear profile 58 of the blade holder 14 and the rear profile 60 of the frame component 12 is 3 mm. Compared to the closed position, the angle between the blade holder and the frame component has decreased by 21° and the distance b by 18 mm.

FIG. 7*c* reveals that in the doctor apparatus according to the invention the blade holder has turned more relative to the frame component than in the doctor apparatus according to prior art. Compared to the closed position, the angle between the blade holder and the frame component has decreased 7° more in the blade holder according to the invention than in the blade holder according to prior art. The gap c indicates how much more the blade of the doctor apparatus according to the invention has turned compared to the blade of the doctor apparatus according to prior art. The gap c is 16 mm whereby removing the blade from the doctor apparatus according to the invention is easier than before.

In the doctor apparatus 10 shown in FIG. 7*b*, the depressurized loading hose 24 includes a first wall portion 62 on the inner surface 63, a second wall portion 64 on the inner surface 65, and a third wall portion 66, which is between the inner surface 63 of the first wall portion 62 and the inner surface 65 of the second wall portion 64. The third wall portion being located between the inner surface of the first wall portion and the inner surface of the second wall portion, the third wall portion is located in the area defined together by the first wall portion and the second wall portion. When the third wall portion is bent between the first and the second wall portions, the loading hose can be made very small. On the other hand, the loading hose is large when pressurized. Such a design enables greater deformations than before for the loading hose. Then the blade movement relative to the surface to be doctored is greater than before. Advantageously, the first wall portion and the second wall portion are curved. A curved shape assists in putting the loading hose in place, prevents soiling and enables a hose groove with an advantageous stress distribution.

The invention claimed is:

1. A doctor apparatus for a web forming machine for doctoring a moving surface, comprising:

a frame component;

a blade holder mounted to the frame;

a blade mounted to the blade holder;

a loading element arranged between the frame component and the blade holder, the loading element having two fastening profiles, one of said two profiles attaching to the frame component and the other of said two fastening profiles attaching to the blade holder, the loading element for loading the blade in the blade holder against a surface.

2. The doctor apparatus of claim 1, wherein the blade holder is mounted to the frame by a connection therebetween;

wherein the blade defines a tip, a base, and a plane containing the tip and the base, and the blade defines a rotation direction which moves the tip in rotation toward a position occupied by the base; and wherein the blade and the loading element are arranged on opposite sides of the connection, and the connection mounts the blade holder for rotation in the rotation direction.

3. The doctor apparatus of claim 1 wherein the loading element is a loading hose.

4. The doctor apparatus of claim 3 wherein the loading hose is connectable to a source of vacuum and when connected to the source of vacuum the loading hose has a configuration which detaches the blade from the surface.

5. The doctor apparatus of claim 4 wherein the loading hose includes a first wall portion, a second wall portion and a third wall portion and the first and second fastening profiles are located on either side of the third wall portion.

6. The doctor apparatus of claim 5 wherein the loading hose is a circuit formed by the first wall portion, the second wall portion, the third wall portion and a fourth wall portion.

7. The doctor apparatus of claim 3 wherein the cross section of a wall forming the loading hose is curved over a portion exceeding 70% or 90% of the wall forming the loading hose.

8. The doctor apparatus of claim 3 wherein the loading hose includes a first wall portion which is outwardly curved, a second wall portion which is outwardly curved, and a third wall portion which is outwardly curved.

9. The doctor apparatus of claim 3 wherein the loading hose is connected to a source of vacuum and wherein the loading hose has an inner surface exposed to the source of vacuum, the inner surface including a first wall portion on the inner surface, a second wall portion on the inner surface and a third wall portion on the inner surface, wherein the third wall portion is between the first wall portion and the second wall portion.

10. The doctor apparatus of claim 9 wherein the first wall portion and the second wall portion are curved.

11. The doctor apparatus of claim 3 wherein the cross section of the loading hose is substantially circular at a selected stage of loading.

12. A doctor apparatus for a web forming machine for doctoring a moving surface, comprising:

a frame component;

a blade holder mounted to the frame;

a blade mounted to the blade holder;

a loading element arranged between the frame component and the blade holder, and tied to both the frame component and the blade holder, the loading element for loading the blade in the blade holder against a surface;

wherein the blade holder is mounted to the frame by a connection therebetween;

wherein the blade defines a tip, a base, and a plane containing the tip and the base, and the blade defines a rotation direction which moves the tip in rotation toward a position occupied by the base; and wherein the blade and the loading element are arranged on opposite sides of the connection, and the connection mounts the blade holder for rotation in the rotation direction, wherein the loading element is a loading hose and wherein the loading hose includes a first fastening profile, and a second opposite fastening profile, wherein the first fastening profile connects the loading hose to the frame component, and the second fastening profile connects the loading hose to the blade holder.

13. The doctor apparatus of claim 12 wherein the fastening profiles protrude from the loading hose.

14. The doctor apparatus of claim 12 wherein the blade holder has portions defining a first hose groove, and the frame component has portions defining a second hose groove and wherein the loading hose is located in the first and second hose grooves, wherein the hose grooves define a hose diameter line such that the first and second fastening profiles are on opposite sides of the diameter line relative to the connection allowing turning between the blade holder and the frame component.

15. The doctor apparatus of claim 12 wherein an angle $\lambda$ is defined between the opposite fastening profiles and is between 40°-140°.

16. The doctor apparatus of claim 15 wherein the angle $\lambda$ is between 70°-110°.

17. A doctor apparatus in a web forming machine for doctoring a moving surface, comprising:

a cylindrical roll mounted in the web forming machine to rotate about a cylinder axis, the roll having a cylindrical surface which moves when the cylindrical roll rotates about the cylinder axis;

a frame component, fixedly mounted with respect to the cylindrical roll axis;

a blade holder mounted to the frame for rotation about a connecting component;

a doctor blade mounted to the blade holder, and extending parallel to the cylinder axis, and having a blade tip engageable with the cylindrical surface, the doctor blade in the blade holder being mounted by the connecting component to the frame component for rotation about a connecting component axis which is parallel to the cylinder axis into and out of engagement with the cylindrical surface;

a loading tube arranged between the frame component and the blade holder, and tied to both the frame component and the blade holder, the loading tube located opposite the blade tip with the connecting component therebetween;

wherein the loading tube is switchably connected to a source of pressurized air for expanding the loading tube to cause rotation of the blade holder and blade about the connecting component axis to load the blade in the blade holder against the cylindrical surface, and wherein the loading tube is switchably connected to a source of vacuum for collapsing the loading tube to cause rotation of the blade holder and blade about the connecting component axis to lift the blade in the blade holder away from the cylindrical surface, wherein the loading tube further comprises a substantially cylindrical loading tube having a first profile extending from and along the tube, and a second profile extending from and along the tube spaced apart from the first profile between 70°-110° about a circumference defined by the loading tube, and wherein the first profile engages a complementary counter profile defined by a portion of the frame, so the first profile is tied to the frame, and the second profile engages a complementary counter profile defined by portions of the blade holder so that the second profile is tied to the blade holder.

* * * * *